US011667870B2

(12) United States Patent
Franklin

(10) Patent No.: US 11,667,870 B2
(45) **Date of Patent: *Jun. 6, 2023**

(54) TRIGLYCERIDE OIL COMPOSITIONS

(71) Applicant: Checkerspot, Inc., Alameda, CA (US)

(72) Inventor: Scott Franklin, Berkeley, CA (US)

(73) Assignee: CHECKERSPOT, INC., Alameda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/512,427

(22) Filed: Oct. 27, 2021

(65) Prior Publication Data

US 2022/0119735 A1 Apr. 21, 2022

Related U.S. Application Data

(63) Continuation of application No. 17/396,876, filed on Aug. 9, 2021, now abandoned, which is a (Continued)

(51) Int. Cl.

| | |
|---|---|
| ***C11C 3/06*** | (2006.01) |
| ***C10M 105/26*** | (2006.01) |
| ***C11C 1/00*** | (2006.01) |

(52) U.S. Cl.

CPC ..... *C11C 3/06* (2013.01); *C10M 105/26* (2013.01); *C11C 1/002* (2013.01); *C10M 2207/401* (2013.01)

(58) Field of Classification Search

CPC ..... C11C 3/08; C11C 1/002; C10M 105/26; C10M 2207/401

See application file for complete search history.

(56) References Cited

U.S. PATENT DOCUMENTS 4,545,941 A 10/1985 Rosenburg
6,414,172 B1 7/2002 Garces et al.
(Continued)

FOREIGN PATENT DOCUMENTS

WO WO-2008151149 A2 12/2008
WO WO-2010006032 A1 1/2010
(Continued)

OTHER PUBLICATIONS

Lin et al. Genetic engineering of microorganisms for biodiesel production. Bioengineered. Sep. 1, 2013; 4(5): 292-304. Published online Dec. 6, 2012. doi: 10.4161/bioe.23114.
(Continued)

*Primary Examiner* — Cephia D Toomer
(74) *Attorney, Agent, or Firm* — Wilson Sonsini Goodrich & Rosati

(57) ABSTRACT

This disclosure provides a triglyceride oil possessing an extremely low cloud point and low viscosity concomitant with a higher than anticipated saturated fatty acid content, very low polyunsaturated fatty acid content, and low iodine value. While many naturally occurring triglyceride oils possess one or more of these properties, natural triglyceride oils lack one or more of these attributes, thus making them less than ideal in industrial applications, such as lubricants, fuels, or dielectric fluids. The combination of attributes possessed by a triglyceride oil described herein, achieved without the addition of any additives, is unique compared with natural counterparts and as such, can find wide applications in the aforementioned fields.

20 Claims, 4 Drawing Sheets

Related U.S. Application Data continuation of application No. 17/068,100, filed on Oct. 12, 2020, now Pat. No. 11,118,134, which is a continuation of application No. PCT/US2020/017634, filed on Feb. 11, 2020.

(60) Provisional application No. 62/804,116, filed on Feb. 11, 2019.

(56) References Cited

U.S. PATENT DOCUMENTS

| | | | | |
|---|---|---|---|---|
| 7,883,882 | B2 | 2/2011 | Franklin et al. | |
| 11,118,134 | B2 | 9/2021 | Franklin | |
| 11,208,369 | B2 | 12/2021 | Petrovic et al. | |
| 2010/0311992 | A1 | 12/2010 | Petrovic et al. | |
| 2011/0113679 | A1 | 5/2011 | Cohen et al. | |
| 2012/0073186 | A1 | 3/2012 | Knuth et al. | |
| 2012/0135479 | A1* | 5/2012 | Dillon | C11B 1/106 554/20 |
| 2013/0323382 | A1 | 12/2013 | Franklin et al. | |
| 2016/0002566 | A1 | 1/2016 | Vanhercke et al. | |
| 2016/0312151 | A1 | 10/2016 | Narine et al. | |
| 2018/0127350 | A1 | 5/2018 | Hapiot et al. | |
| 2018/0237811 | A1 | 8/2018 | Franklin et al. | |
| 2022/0324198 | A1 | 10/2022 | Sterbenz et al. | |
| 2022/0356292 | A1 | 11/2022 | Sterbenz et al. | |

FOREIGN PATENT DOCUMENTS

| | | | |
|---|---|---|---|
| WO | WO-2010063031 | A2 | 6/2010 |
| WO | WO-2010120923 | A1 | 10/2010 |
| WO | WO-2010120939 | A2 | 10/2010 |
| WO | WO-2011150410 | A2 | 12/2011 |
| WO | WO-2012061647 | A2 | 5/2012 |
| WO | WO-2012106560 | A1 | 8/2012 |
| WO | WO-2013082186 | A2 | 6/2013 |
| WO | WO-2013158938 | A1 | 10/2013 |
| WO | WO-2014176515 | A2 | 10/2014 |
| WO | WO-2015051319 | A2 | 4/2015 |
| WO | WO-2020047216 | A1 | 3/2020 |
| WO | WO-2020167745 | A1 | 8/2020 |
| WO | WO-2021127181 | A1 | 6/2021 |
| WO | WO-2021150923 | A1 | 7/2021 |
| WO | WO-2021247368 | A1 | 12/2021 |
| WO | WO-2022221402 | A1 | 10/2022 |

OTHER PUBLICATIONS

Patel et al. High conversion and productive catalyst turnovers in cross-metathesis reactions of natural oils with 2-butene. Green Chemistry, vol. 8, No. 5, pp. 450-454 (2006). First published online Mar. 22, 2006. DOI: https://doi.org/10.1039/B600956E.

PCT/US2019/048751 International Search Report and Written Opinion dated Dec. 31, 2019.

PCT/US2020/017634 International Search Report and Written Opinion dated Jul. 7, 2020.

Petrović et al. Polyols and Polyurethanes from Crude Algal Oil. Journal of the American Oil Chemists' Society, vol. 90, Issue 7, pp. 1073-1078 (Jul. 2013). First published Apr. 18, 2013. doi: https://doi.org/10.1007/s11746-013-2245-9.

Robert O. Dunn (2011). Improving the Cold Flow Properties of Biodiesel by Fractionation, Soybean—Applications and Technology, Prof. Tzi-Bun Ng (Ed.), ISBN: 978-953-307-207-4, InTech, Available from: http://www.intechopen.com/books/soybean-applications-and-technology/improving-the-cold-flow-properties-ofbiodiesel-by-fractionation. Published online Apr. 26, 2011. 30 pages.

Shi et al. Metabolic Engineering of Oleaginous Yeasts for Production of Fuels and Chemicals. Front Microbiol. 2017; 8: 2185. Published online Nov. 8, 2017. doi: 10.3389/fmicb.2017.02185. 16 pages.

Uprety et al. Utilization of microbial oil obtained from crude glycerol for the production of polyol and its subsequent conversion to polyurethane foams. Bioresour Technol. Jul. 2017;235:309-315. doi: 10.1016/j.biortech.2017.03.126. Epub Mar. 24, 2017.

Co-pending U.S. Appl. No. 17/396,876, inventor Franklin; Scott, filed Aug. 9, 2021.

Co-pending U.S. Appl. No. 17/530,235, inventors Petrovic; Zoran et al., filed Nov. 18, 2021.

U.S. Appl. No. 17/068,100 Office Action dated May 5, 2021.

U.S. Appl. No. 17/068,100 Notice of Allowance dated Jul. 8, 2021.

U.S. Appl. No. 17/068,100 Office Action dated Jan. 25, 2021.

Co-pending U.S. Appl. No. 18/072,224, inventors Franklin; Scott et al., filed Nov. 30, 2022.

* cited by examiner

TRIGLYCERIDE OIL COMPOSITIONS

CROSS REFERENCE

This application is a continuation of U.S. application Ser. No. 17/396,876, filed Aug. 9, 2021, which is a continuation of U.S. application Ser. No. 17/068,100, filed Oct. 12, 2020, now U.S. Pat. No. 11,118,134, which is a continuation of International Application No. PCT/US2020/017634, filed Feb. 11, 2020, which claims the benefit of U.S. Provisional Application No. 62/804,116, filed on Feb. 11, 2019, each of which is incorporated herein by reference in its entirety.

BACKGROUND

The global oleochemicals market generates roughly $25 billion in revenue and is forecast to grow to $31 billion by 2025. The industry produces feedstocks (triglyceride oils, fatty acids, phospholipids, sterols, etc.) that permeate many aspects of daily life. These materials are used in food, personal care product, industrial, automotive, and polymer applications. Surprisingly, this industry relies on just fourteen fatty acids, derived primarily from plant sources, to produce all the feedstock material for these myriad applications. This paucity of diversity in fatty acid constituents occurs despite the fact that oilseeds in nature are known to elaborate over 500 distinct fatty acid moieties. The reason that so few of these chemical entities find their way into this large market is because less than twenty oilseed crops are grown at the industrial scale. As a consequence, most oil chemists focus on developing materials and applications around existing triglyceride oils and fatty acids.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

SUMMARY

Figure 1:
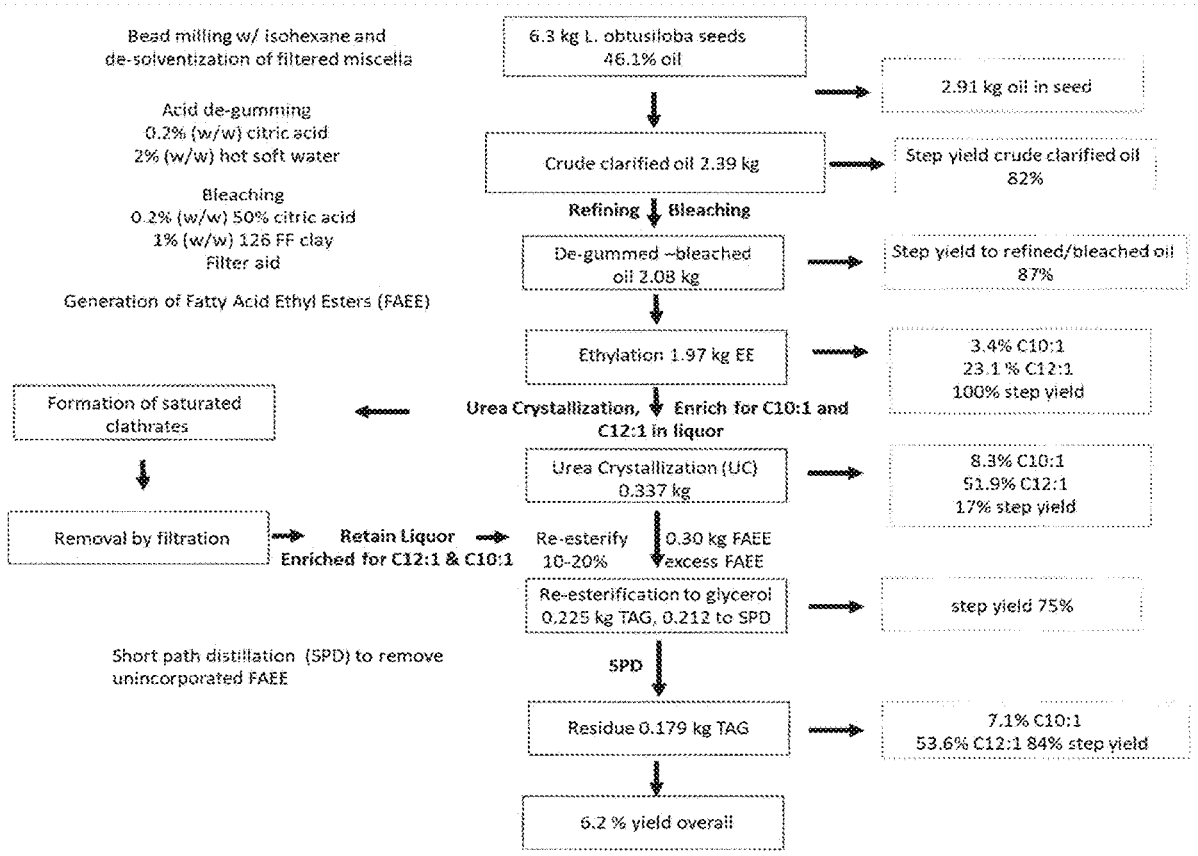
FIG. 1 illustrates a flow diagram for the preparation of a TAG enriched in C10:1 and C12:1 fatty acids.

In some aspects, the present disclosure provides a triglyceride oil comprising 6% or more of a C10:1 fatty acid on a weight percentage basis.

In some embodiments, the oil further comprises 25% or more of any one or more of a C10:1 fatty acid and a C12:1 fatty acid, or a combination thereof, on a weight percentage basis.

In some embodiments, the oil further comprises 94% or more of a medium-chain fatty acid (MCFA) on a weight percentage basis. In some embodiments, the MCFA is a C8 fatty acid, a C10 fatty acid, a C12 fatty acid, a C14 fatty acid, or a combination thereof.

In some embodiments, the oil further comprises 67% or more of a monoenic fatty acid (MEFA), a polyunsaturated fatty acid (PUFA), or a combination thereof, on a weight percentage basis.

In some embodiments, the oil further comprises 65% or more of the MEFA on a weight percentage basis. In some embodiments, the MEFA is a C10:1 fatty acid, a C12:1 fatty acid, a C14:1 fatty acid, a C16:1 fatty acid, a C18:1 fatty acid, a C20:1 fatty acid, a C22:1 fatty acid, a C24:1 fatty acid, or a combination thereof.

In some embodiments, the oil further comprises 7% or more of a C10:1 fatty acid and 55% or more of a C12:1 fatty acid on a weight percentage basis.

In some embodiments, the oil further comprises up to 2% of a C18:1 fatty acid on a weight percentage basis. In some embodiments, the oil further comprises a C18:1 fatty acid at a weight percentage of up to 2%.

In some embodiments, the oil further comprises up to 3% of the PUFA on a weight percentage basis. In some embodiments, the oil further comprises the PUFA at a weight percentage of up to 3%.

In some embodiments, the oil further comprises the PUFA is a C18:2 fatty acid, a C18:3 fatty acid, a C22:2 fatty acid, or a combination thereof.

In some embodiments, the oil further comprises up to 3% of a C18:2 fatty acid on a weight percentage basis. In some embodiments, the oil further comprises a C18:2 fatty acid at a weight percentage of up to 3%.

In some embodiments, the oil further comprises 32% or more of a saturated fatty acid on a weight percentage basis. In some embodiments, the saturated fatty acid is a C6:0 fatty acid, a C8:0 fatty acid, a C10:0 fatty acid, a C12:0 fatty acid, a C14:0 fatty acid, a C16:0 fatty acid, a C18:0 fatty acid, a C20:0 fatty acid, a C22:0 fatty acid, a C24:0 fatty acid, or a combination thereof.

In some embodiments, the oil further comprises up to 1% of a C6:0 fatty acid on a weight percentage basis. In some embodiments, the oil further comprises a C6:0 fatty acid at a weight percentage of up to 1%.

In some embodiments, the oil further comprises up to 1% of a C8:0 fatty acid on a weight percentage basis. In some embodiments, the oil further comprises a C8:0 fatty acid at a weight percentage of up to 1%.

In some embodiments, the oil further comprises 20% or more of a C10:0 fatty acid on a weight percentage basis. In some embodiments, the oil further comprises a C10:0 fatty acid at a weight percentage of up to 23%.

In some embodiments, the oil further comprises up to 9% of a C12:0 fatty acid on a weight percentage basis. In some embodiments, the oil further comprises a C12:0 fatty acid at a weight percentage of up to 9%.

In some embodiments, the oil further comprises up to 1% of a C14:0 fatty acid on a weight percentage basis. In some embodiments, the oil further comprises a C14:0 fatty acid at a weight percentage of up to 1%.

In some embodiments, the oil further comprises up to 1% of a C16:0 fatty acid on a weight percentage basis. In some embodiments, the oil further comprises a C16:0 fatty acid at a weight percentage of up to 1%.

In some embodiments, the oil further comprises up to 1% of a C18:0 fatty acid on a weight percentage basis. In some embodiments, the oil further comprises a C18:0 fatty acid at a weight percentage of up to 1%.

In some aspects, the present disclosure provides a triglyceride oil comprising up to 1% of a C8:0 fatty acid, up to 23% of a C10:0 fatty acid, up to 9% of a C12:0 fatty acid, up to 1% of a C14:0 fatty acid, and up to 1% of a C16:0 fatty acid on a weight percentage basis.

In some aspects, the present disclosure provides a triglyceride oil comprising up to 1% of a C8:0 fatty acid, up to 23% of a C10:0 fatty acid, 7% or more of a C10:1 fatty acid, up to 8% of a C12:0 fatty acid, 55% or more of a C12:1 fatty acid, and up to 1% of a C14:0 fatty acid on a weight percentage basis.

In some embodiments, the oil has a cloud point that is −11° C. or lower. In some embodiments, the oil has a cloud point that is −18° C. or lower. In some embodiments, the oil has a cloud point that is −18° C.

In some embodiments, the oil has a pour point that is −45° C. or lower. In some embodiments, the oil has a pour point that is −45° C.

In some embodiments, the oil has an iodine value that is 83 or higher. In some embodiments, the oil has an iodine value that is between 44 and 82. In some embodiments, the oil has an iodine value that is 83.

In some embodiments, the oil has a kinematic viscosity that is up to 80 cSt. In some embodiments, the oil has a kinematic viscosity that is up to 42 cSt. In some embodiments, the oil has a kinematic viscosity that is 42 cSt.

In some aspects, the present disclosure provides a triglyceride oil comprising up to 3% of a polyunsaturated fatty acid (PUFA) on a weight percentage basis, wherein the oil has a kinematic viscosity that is up to 42 cSt, and wherein the oil has a cloud point that is −18° C. or lower.

In some embodiments, the oil further comprises a PUFA at a weight percentage of up to 3%.

In some embodiments, the PUFA is a C18:2 fatty acid, a C18:3 fatty acid, a C22:2 fatty acid, or a combination thereof.

In some embodiments, the oil further comprises up to 3% of a C18:2 fatty acid on a weight percentage basis. In some embodiments, the oil further comprises a C18:2 fatty acid at a weight percentage of up to 3%.

In some embodiments, the oil has a kinematic viscosity that is 42 cSt. In some embodiments, the oil has a cloud point that is −18° C.

In some embodiments, the oil has an iodine value that is 83 or higher. In some embodiments, the oil has an iodine value that is between 44 and 82. In some embodiments, the oil has an iodine value that is 83.

In some aspects, the present disclosure provides a triglyceride oil comprising 32% or more of a saturated fatty acid on a weight percentage basis, wherein the oil has a cloud point that is −18° C. or lower.

In some embodiments, the saturated fatty acid is a C6:0 fatty acid, a C8:0 fatty acid, a C10:0 fatty acid, a C12:0 fatty acid, a C14:0 fatty acid, a C16:0 fatty acid, a C18:0 fatty acid, a C20:0 fatty acid, a C22:0 fatty acid, a C24:0 fatty acid, or a combination thereof.

In some embodiments, the oil further comprises up to 1% of a C6:0 fatty acid on a weight percentage basis. In some embodiments, the oil further comprises a C6:0 fatty acid at a weight percentage of up to 1%.

In some embodiments, the oil further comprises up to 1% of a C8:0 fatty acid on a weight percentage basis. In some embodiments, the oil further comprises a C8:0 fatty acid at a weight percentage of up to 1%.

In some embodiments, the oil further comprises 20% or more of a C10:0 fatty acid on a weight percentage basis. In some embodiments, the oil further comprises a C10:0 fatty acid at a weight percentage of up to 23%.

In some embodiments, the oil further comprises up to 9% of a C12:0 fatty acid on a weight percentage basis. In some embodiments, the oil further comprises a C12:0 fatty acid at a weight percentage of up to 9%.

In some embodiments, the oil further comprises up to 1% of a C14:0 fatty acid on a weight percentage basis. In some embodiments, the oil further comprises a C14:0 fatty acid at a weight percentage of up to 1%.

In some embodiments, the oil further comprises up to 1% of a C16:0 fatty acid on a weight percentage basis. In some embodiments, the oil further comprises a C16:0 fatty acid at a weight percentage of up to 1%.

In some embodiments, the oil further comprises up to 1% of a C18:0 fatty acid on a weight percentage basis. In some embodiments, the oil further comprises a C18:0 fatty acid at a weight percentage of up to 1%.

In some embodiments, the oil has a cloud point that is −18° C. In some embodiments, the oil has a pour point that is −45° C. or lower. In some embodiments, the oil has a pour point that is −45° C.

In some embodiments, the oil has an iodine value that is 83 or higher. In some embodiments, the oil has an iodine value that is between 44 and 82. In some embodiments, the oil has an iodine value that is 83.

In some embodiments, the oil has a kinematic viscosity that is up to 80 cSt. In some embodiments, the oil has a kinematic viscosity that is up to 42 cSt. In some embodiments, the oil has a kinematic viscosity that is 42 cSt.

In some embodiments, the weight percentage or the weight percentage basis is determined by gas chromatography and flame ionization detection.

In some embodiments, the oil is isolated.

In some embodiments, the oil is not naturally occurring.

In some embodiments, the oil is cell free.

In some embodiments, the oil is produced in planta.

In some embodiments, the oil is produced ex planta.

In some embodiments, the oil is produced through chemical re-esterification of fatty acid esters to glycerol.

In some embodiments, the oil is produced through strain selection.

In some embodiments, the oil is produced through cross-breeding.

In some embodiments, the oil is produced through genetic engineering.

In some embodiments, the oil does not contain an additive. In some embodiments, the additive is a cloud point depressant or a pour point depressant. In some embodiments, the additive is a biodiesel, a mineral oil, a petroleum-based additive, a polyalkylmethaacrylate (PAMA), a polyacrylate, an acrylate-styrene copolymer, an esterified olefin copolymer, a styrene maleic anhydride copolymer, an alkylated polystyrene, a vinyl acetate-fumarate copolymer, or a halogenated wax.

In some aspects, the present disclosure provides a polyol produced from a triglyceride oil described herein.

In some aspects, the present disclosure provides a polyurethane produced from a triglyceride oil described herein.

In some aspects, the present disclosure provides a lubricant produced from a triglyceride oil described herein.

In some aspects, the present disclosure provides a dielectric fluid produced from a triglyceride oil described herein.

In some aspects, the present disclosure provides a heat transfer fluid produced from a triglyceride oil described herein. In some embodiments, the heat transfer fluid is a coolant.

In some aspects, the present disclosure provides a fuel produced from a triglyceride oil described herein. In some embodiments, the fuel is diesel.

In some aspects, the present disclosure provides a personal care product produced from a triglyceride oil described herein. In some embodiments, the personal care product is a lubricant, a hair oil, a body oil, a bath oil, an emollient, a moisturizer, a lotion, a skin cream, a sun care product, a balm, or a soap.

In some aspects, the present disclosure provides a method of producing a triglyceride oil described herein, comprising: (a) subjecting a purified crude oil to transesterification to generate fatty acid ethyl esters (FAEE); (b) subjecting the FAEE to urea crystallization, thereby generating a liquor enriched in a mid-chain monoenic fatty acid; and (c) subjecting the liquor to re-esterification to glycerol to generate the oil.

In some embodiments, the mid-chain monoenic fatty acid is a C8 fatty acid, a C10 fatty acid, a C12 fatty acid, a C14 fatty acid, or a combination thereof. In some embodiments, the mid-chain monoenic fatty acid is a C10 fatty acid, a C12 fatty acid, or a combination thereof.

In some embodiments, the method further comprises extracting the crude oil from a seed.

In some embodiments, the extracting comprises bead milling in the presence of isohexane.

In some embodiments, the method further comprises purifying the crude oil, thereby generating the purified crude oil.

In some embodiments, the purifying comprises bleaching the crude oil. In some embodiments, the bleaching is in presence of a bleaching clay. In some embodiments, the bleaching clay is 126 FF clay.

In some embodiments, the purifying comprises degumming the crude oil with an acid. In some embodiments, the acid is citric acid.

In some embodiments, the transesterification comprises reacting the purified crude oil with ethanol. In some embodiments, the transesterification is in presence of sodium ethoxide or potassium ethoxide.

In some embodiments, the method further comprises washing the urea-FAEE clathrates with cold methanol.

In some embodiments, the method further comprises separating the urea-FAEE clathrates from the liquor by filtration.

In some embodiments, the method further comprises removing excess urea from the liquor by aqueous extraction.

In some embodiments, the method further comprises removing unincorporated fatty acids from the liquor by short path distillation.

In some aspects, the present disclosure provides a method of producing a polyol, comprising obtaining a triglyceride oil described herein, and generating the polyol from the oil.

In some aspects, the present disclosure provides a method of producing a polyurethane, comprising obtaining a triglyceride oil described herein, and generating the polyurethane from the oil.

In some aspects, the present disclosure provides a method of producing a polyurethane, comprising obtaining a triglyceride oil described herein; converting the oil to a polyol; and reacting the polyol with an isocyanate, thereby generating the polyurethane from the oil.

In some aspects, the present disclosure provides a method of producing a lubricant, comprising obtaining a triglyceride oil described herein.

In some aspects, the present disclosure provides a method of producing a dielectric fluid, comprising obtaining a triglyceride oil described herein, and generating the dielectric fluid from the oil.

In some aspects, the present disclosure provides a method of producing a heat transfer fluid, comprising obtaining a triglyceride oil described herein, and generating the heat transfer fluid from the oil. In some embodiments, the heat transfer fluid is a coolant.

In some aspects, the present disclosure provides a method of producing a fuel, comprising obtaining a triglyceride oil described herein, and generating the fuel from the oil. In some embodiments, the fuel is a diesel.

In some aspects, the present disclosure provides a method of producing a personal care product, comprising: obtaining a triglyceride oil described herein, and generating the personal care product from the oil, wherein the personal care product is a lubricant, a hair oil, a body oil, a bath oil, an emollient, a moisturizer, a lotion, a cream, a sun care product, a balm, or a soap.

DETAILED DESCRIPTION

The present invention describes triglyceride oil compositions and preparation methods thereof. These triglyceride oils possess a unique combination of physicochemical properties including, for example, a very low cloud point, a very low pour point, a very low Mettler dropping point, low viscosity, and low iodine value. The triglyceride oils can be prepared through a process of transesterification to generate fatty acid ethyl esters (FAEEs), followed by the selective enrichment of monounsaturated components by urea crystallization, and subsequent re-esterification of the FAEEs to form a glycerol backbone, and removal of non-esterified components via short path distillation.

Triglyceride oil compositions can be useful in myriad applications of liquid oils, for example, in applications in which cold flow properties, high oxidative stability, low viscosity, and combinations thereof, are important. Non-limiting examples of such applications include lubricants, lubricant additives, fuels, fuel additives, dielectric fluids, polyols, polyurethanes, and personal care products. In addition, such triglyceride oils can be useful as a feedstock for the generation of natural oil polyols through processes such as epoxidation and ring opening, hydroformylation and reduction, and ozonolysis.

As used herein, the term "fatty acid ethyl ester" or "FAEE" refers to the product formed by the esterification of ethanol with a fatty acid.

As used herein, the term "esterification" refers to the reaction of a carboxylic acid ester with an alcohol in the presence of a catalyst.

As used herein, the term "transesterification" refers to the conversion of a triglyceride to a fatty acid alkyl ester and glycerol in the presence of an alcohol and a catalyst.

As used herein, the term "cloud point" refers to the temperature below which an oil composition forms a cloudy appearance as a result of partial solidification and/or formation of wax. In some embodiments, cloud point is determined by AOCS Method Cc 6-25.

As used herein, the term "dropping point" or "Mettler dropping point" refers to the temperature at which an oil composition passes from a semi-solid to a liquid state under specific test conditions. In some embodiments, Mettler dropping point is determined by AOCS Method Cc 18-80.

As used herein, the term "pour point" refers to the temperature at which an oil composition loses its flow properties. The pour point can be defined as the minimum temperature in which the oil has the ability to pour down from a beaker. In some embodiments, pour point is determined by ASTM Method D97.

As used herein, the term "rheological properties" refers to the flow behavior of an oil composition. In some embodiments, rheological properties are determined by ASTM Method D445.

As used herein, the term "cold flow properties" refers to the flow behavior of an oil composition in low temperature environments.

As used herein, the term "iodine value" is an indicator of the number of double bonds in the fatty acids of an oil composition. Iodine value is determined by the mass of iodine in grams that is consumed by 100 grams of an oil composition.

As used herein, the term "triacylglycerol", "triglyceride", or "TAG" refers to an oil composed of three saturated and/or unsaturated fatty acids held together by a glycerol backbone.

As used herein, the term "monoenic fatty acid" or "MEFA" refers to a fatty acid having one double bond in the backbone. For example, C10:1 and C12:1 are each monoenic fatty acids.

As used herein, the term "polyunsaturated fatty acid" or "PUFA" refers to a fatty acid having more than one double bond in the backbone. For example, C18:2 is a polyunsaturated fatty acid.

As used herein, the term "medium chain fatty acids," "mid-chain fatty acids," or "MCFA" refers to C8, C10, C12, or C14 fatty acids.

As used herein, the term "mid-chain triglyceride oil" or "MCT oil" refers to an oil containing C8, C10, C12, or C14 fatty acids.

As used herein, the term "natural oil," "natural triglyceride oil," or "naturally occurring oil" refers to an oil derived from a plant, animal, fungi, algae, or bacterium that has not undergone additional chemical or enzymatic manipulation. In some embodiments, the term can exclude refining processes, for example, degumming, refining, bleaching, or deodorization.

As used herein, the term "natural oil polyol" refers to a polyol produced in situ by a plant, animal, fungi, algae, or bacterium, or through chemical modifications of a triglyceride oil derived from a plant, animal, fungi, algae, or bacterium.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present teachings, some exemplary methods and materials are described herein.

Provided herein are triglyceride oils having unique or optimal compositional and physicochemical properties. These triglyceride oils are derived from enrichment of distinct fatty acid components and the subsequent reintegration thereof onto a glycerol backbone.

In the area of lubricants, a desirable natural triglyceride oil is one that is a liquid at room temperature, and exhibits superior cold flow properties, excellent oxidative stability, and low viscosity. However, existing, natural lubricating oils are wanting in one or more of these key attributes. As outlined in TABLE 2, these natural oils include, for example, safflower oil, hempseed oil, meadowfoam oil, palm kernel oil, grapeseed oil, mid-chain triglyceride oil, castor oil, and soybean oil.

While some naturally occurring triglycerides perform well with respect to one or two of these properties, there is currently not a naturally occurring oil that exhibits all or most of the desirable qualities across the board. For example, highly polyunsaturated natural oils (i.e. soy, grapeseed, hemp, and safflower) generally confer desirable cold flow properties, but their iodine values are relatively high, indicating relatively poor oxidative stability. Oxidative stability can be a desirable feature in lubricating oils, dielectric fluids, and fuels.

Increasing levels of unsaturation of fatty acid moieties is a key propagator of free radical chemistries which can result in allelic hydroperoxide formation and subsequent polymerization of the triglycerides themselves. Thus, increasing the number of carbon-carbon double bonds or iodine value of a triglyceride can reduce oxidative stability of the triglyceride. The relative rate of autooxidation can be strongly influenced by the presence of double bonds that are separated by a single methylene group and the total number of double bonds. As an example, the relative rates of oxidation of oleate (C18:1 $\Delta^{9}$), linoleate (C18:2 $\Delta^{9,12}$), and linolenate (C18:3 $\Delta^{9,12,15}$) are roughly 1:27:77.

At the opposite end of the spectrum, mid-chain triglyceride (MCT) oils, such as those prepared via the re-esterification of C10:0 and C8:0 fatty acids derived from palm kernel and coconut oils, have excellent rheological properties (low kinematic viscosity) and very low iodine values. Cold flow properties (as assessed by cloud point) of MCT oils are wanting, however, as most of the highly polyunsaturated oils exhibit significantly lower cloud points. Even slightly increasing the chain length C12 fatty acids dramatically increases the cloud point of the triglyceride, even though the iodine value of the oil is significantly lower than that of the more highly polyunsaturated oils.

High oleic oils, which have a much higher iodine value than MCT oils, can be an attractive alternative. The high concentrations of oleate (a monoenic fatty acid) attributes to desirable properties, such as being far less reactive to oxidation than the more highly polyunsaturated counterparts. Castor oil (C18:1 $\Delta^{9}$, 12-OH) is another attractive alternative, possessing a desirable iodine value for good oxidative stability (similar to a high oleic oil) and excellent cold flow properties (e.g., low cloud point). Unfortunately, the exceptionally high viscosity of castor oil attributed to the hydroxyl moiety at the 12 position severely limits its applicability in many of the fields described above.

In some embodiments, a triglyceride oil described herein can be derived from a natural oil plant seed and enrich for mid-chain monoenic fatty acids. Non-limiting examples of natural oil plant seed species include *Lindera obtusiloba, Litsea cubeba*, and species of the Lauraceae family.

In some embodiments, a triglyceride oil described herein can be obtained from repeated intrageneric and intergeneric crossbreeding of plant seed cultivars and selection for oils having increasing levels of mid-chain monoenic fatty acids in the resulting from progeny of the cultivars.

In some embodiments, a triglyceride oil described herein can be obtained from cultivars whose seeds have been subjected to mutagenesis followed by selection for oils having increasing levels of mid-chain monoenic fatty acids in the resulting from the mutagenized parent seeds.

In some embodiments, a triglyceride oil described herein can be obtained from cultivars whose seeds have been subjected to mutagenesis followed by selection for the oil described herein in seeds resulting from the mutagenized parent seeds, and subjecting the resulting progeny the first mutagenic event to intrageneric and intergeneric crossbreeding, followed by selection for increasing levels of midchain monoenic fatty acids in the seed oils resulting from their progeny.

In some embodiments, a triglyceride oil described herein can be derived from oil extracted from the seeds of *Lindera obtusiloba*, known as the Japanese spice bush. Seeds of *L. obtusiloba* contain mid-chain monoenic fatty acids, for example, C10:1 $\Delta^4$ and C12:1 $\Delta^4$ at an amount of up to about 40% in total. In the example shown in TABLE 2, the *L. obtusiloba* seed oil is composed of about 21% C12:1 and about 3% C10:1 fatty acids (column labeled "L. *obtusiloba* seed oil"). An enriched *L. obtusiloba* seed oil enriched in mid-chain monoenic fatty acids contained about 55% C12:1 and about 7% C10:1 fatty acids (column labeled "Enriched TAG").

In some embodiments, a triglyceride oil described herein can be derived from oil extracted from the seeds of *Litsea cubeba*, known as mountain pepper. TABLE 1 shows the fatty acid compositions of *L. obtusiloba* and *L. cubeba*.

TABLE 1

| FA Species | L. obtusiloba seed oil | L. cubeba seed oil |
|---|---|---|
| C8:0 | 0.46 | 0.18 |
| C10:0 | 32.47 | 27.07 |

TABLE 1-continued

| FA Species | L. obtusiloba seed oil | L. cubeba seed oil |
|---|---|---|
| C10:1 cis4 | 2.93 | 1 |
| C11:0 | 0.1 | 0.09 |
| C12:0 | 28.06 | 54.38 |
| C12:1 cis4 | 21.77 | 4.58 |
| C14:0 | 5.73 | 2.15 |
| C14:1 cis4 | 2.49 | 0.55 |
| C16:0 | 0.32 | 0.52 |
| C18:0 | 0.08 | 0.27 |
| C18:1 | 3.3 | 6.02 |
| C18:2 | 1.92 | 2.85 |
| C18:3 alpha | 0.05 | 0.03 |
| C20:0 | 0.04 | 0.03 |
| C20:1 | 0.13 | 0.17 |

TABLE 2 shows the fatty acid composition and physical properties of eleven natural seed oils and an enriched triglyceride oil derived from *L. obtusiloba*. Physical properties include cloud point (limit of assay was −18° C.), Mettler dropping point (samples showing ND failed to solidify and the freezing points of the sample fell below the limit of the instrument used (−20° C.)), and kinematic viscosity at 23° C., measured in centistokes (cSt). Fatty acid compositions were further characterized via gas chromatography and flame ionization detection (GC-FID) to determine the fatty acid composition by total percentages of monoenic, polyunsaturated, and MCT triglyceride oils.

TABLE 2

| FAME | Enriched TAG | L. obtusiloba Seed Oil | Safflower Oil | Hempseed Oil | Meadwfoam Oil | Palm Kernel Oil (PKO) |
|---|---|---|---|---|---|---|
| C6:0 | 0 | 0 | 0 | 0 | 0 | 0 25 |
| C8:0 | 0 51 | 0 44 | 0 | 0 01 | 0 | 3 81 |
| C10:0 | 22 98 | 30 34 | 0 | 0 | 0 | 3 33 |
| C10:1 | 7 34 | 3 02 | 0 | 0 | 0 | 0 |
| C12:0 | 8 28 | 24 3 | 0 | 0 | 0 | 45 67 |
| C12:1 | 55 18 | 20 57 | 0 | 0 | 0 | 0 |
| C14:0 | 0 95 | 4 65 | 0 08 | 0 03 | 0 | 15 82 |
| C14:1 | 0 09 | 2 29 | 0 | 0 | 0 | 0 |
| C16:0 | 0 13 | 2 97 | 5 20 | 5 92 | 0 10 | 9 11 |
| C16:1 | 0 16 | 0 10 | 0 14 | 0 10 | 0 | 0 02 |
| C18:0 | 0 | 0 22 | 1 94 | 2 52 | 0 11 | 2 30 |
| C18:1 | 1 68 | 7 95 | 75 30 | 11 50 | 0 41 | 16 79 |
| C18:2 | 2 51 | 2 13 | 15 95 | 53 36 | 0 05 | 2 51 |
| C18:3 alpha | 0 12 | 0 16 | 0 09 | 21 23 | 0 15 | 0 01 |
| C18:3 gamma | 0 | 0 | 0 | 2 76 | 0 | 0 |
| C20:0 | 0 | 0 05 | 0 44 | 0 68 | 0 76 | 0 12 |
| C20:1 | 0 04 | 0 13 | 0 35 | 0 48 | 65 | 0 12 |
| C22:0 | 0 03 | 0 06 | 0 32 | 0 33 | 0 | 0 |
| C22:1 | 0 | 0 | 0 | 0 | 14 03 | 0 |
| C22:2 | 0 | 0 | 0 | 0 | 15 73 | 0 |
| C24:0 | 0 | 0 17 | 0 | 0 | 0 | 0 |
| C24:1 | 0 | 0 | 0 | 0 | 2 95 | 0 |
| C18:1-OH | 0 | 0 | 0 | 0 13 | 0 | 0 |
| Cloud Point (° C.) | <−18 | −10 3 | −16 6 | −17 2 | 0 3 | 24 6 |
| Iodine Value | 83 | 42 | 93 3 | 164 | 91 | 19 1 |
| Mettler Dropping Point (° C.) | ND | 6 2 | −1 4 | ND | 5 2 | 29 2 |
| Kinematic Viscosity (cSt) | 42 | 45 2 | 76 1 | 52 5 | 97 1 | 54 9 |
| Monoenic FA | 64 49 | 34 06 | 75 79 | 12 21 | 82 39 | 16 93 |
| Polyunsaturate FA | 2 63 | 2 29 | 16 04 | 77 35 | 15 93 | 2 52 |
| Saturated FA | 32 88 | 63 20 | 7 98 | 9 48 | 0 97 | 80 41 |
| MCT | 94 29 | 79 03 | 0 00 | 0 01 | 0 00 | 52 88 |

TABLE 2-continued

| FAME | Grapeseed Oil | Mid-Chain Triglyceride Oil (MCT Oil) | Castor Oil | Soybean Oil | High Oleic Algal Oil | Mid Oleic Algal Oil |
|---|---|---|---|---|---|---|
| C6:0 | 0 | 0 05 | 0 | 0 | 0 | 0 |
| C8:0 | 0 | 59 16 | 0 | 0 | 0 | 0 |
| C10:0 | 0 | 40 54 | 0 | 0 | 0 | 0 |
| C10:1 | 0 | 0 | 0 | 0 | 0 | 0 |
| C12:0 | 0 | 0 10 | 0 | 0 | 0 | 0 |
| C12:1 | 0 | 0 | 0 | 0 | 0 | 0 |
| C14:0 | 0 04 | 0 | 0 | 0 | 0 44 | 0 94 |
| C14:1 | 0 | 0 | 0 | 0 | 0 | 0 |
| C16:0 | 7 32 | 0 | 1 12 | 11 08 | 2 10 | 18 26 |
| C16:1 | 0 09 | 0 10 | 0 01 | 0 11 | 0 50 | 0 418 |
| C18:0 | 3 69 | 0 | 1 24 | 4 06 | 0 85 | 4 92 |
| C18:1 | 15 12 | 0 | 2 93 | 22 89 | 87 65 | 64 38 |
| C18:2 | 72 09 | 0 | 4 50 | 52 05 | 6 28 | 9 31 |
| C18:3 alpha | 0 43 | 0 | 0 54 | 6 87 | 0 36 | 0 225 |
| C18:3 gamma | 0 | 0 | 0 | 0 | 0 | 0 |
| C20:0 | 0 17 | 0 | 0 05 | 0 41 | 0 | 0 66 |
| C20:1 | 0 19 | 0 | 0 32 | 0 28 | 0 | 0 19 |
| C22:0 | 0 06 | 0 | 0 | 0 38 | 0 | 0 16 |
| C22:1 | 0 | 0 | 0 | 0 | 0 | 0 |
| C22:2 | 0 | 0 | 0 | 0 | 0 | 0 |
| C24:0 | 0 | 0 | 0 | 0 11 | 0 | 0 |
| C24:1 | 0 | 0 | 0 | 0 | 0 | 0 |
| C18:1-OH | 0 | 0 | 88 66 | 0 | 0 | 0 |
| Cloud Point (° C.) | −17 3 | −6 7 | −15 8 | −8 4 | −14 7 | −10 1 |
| Iodine Value | 138 | 0 | 86 1 | 129 | 88 3 | 80 5 |
| Mettler Dropping Point (° C.) | ND | 1 3 | ND | −0 05 | 3 5 | 7 |
| Kinematic Viscosity (cSt) | 52 7 | 27 5 | 831 | 58 | 73 2 | 79 4 |
| Monoenic FA | 15 40 | 0 10 | 91 92 | 23 28 | 88 15 | 64 99 |
| Polyunsaturate FA | 75 52 | 0 00 | 5 04 | 58 92 | 6 64 | 9 54 |
| Saturated FA | 11 28 | 99 85 | 2 41 | 16 04 | 3 39 | 24 95 |
| MCT | 0 00 | 99 85 | 0 | 0 | 0 | 0 |

Seeds and oil of *L. obtusiloba* can be processed as diagramed in FIG. 1. *L. obtusiloba* seeds can be ground in a bead mill with isohexane followed by clarification of the resulting micella, acid degumming, and bleaching. This resultant oil can then be subjected to transesterification to generate FAEE. The FAEE can subsequently be subjected to urea crystallization to generate urea-FAEE clathrates, allowing for enrichment of mid-chain monoenic fatty acids. The urea-FAEE clathrates can then be filtered out from the oil prior to re-esterification of the free fatty acids to a triglyceride.

A partial purification and subsequent enrichment of a mid-chain monoenic fatty acid containing TAG can be carried out by urea crystallization, a process used to purify linear paraffins from other hydrocarbon compounds. Urea crystallization can be used to improve the cold flow properties of biodiesel fuels and to enrich for particular fatty acids in highly polyunsaturated marine oils, for example. During urea crystallization, urea clathrates or lattices that form at low temperatures can entrap saturated fatty acids without disruption of the crystal lattice. However, due to inherent bending properties imparted by the carbon-carbon double bonds of unsaturated fatty acids, unsaturated fatty acids can disrupt the formation of urea-fatty acid clathrates and thus, are largely excluded from the clathrates. Thus, unsaturated fatty acids can be enriched by removing the urea-saturated fatty acid clathrates following urea crystallization. Filtration of the urea-saturated fatty acid adducts or clathrates and subsequent washing with cold methanol can remove non-desired saturated adducts. Unsaturated fatty acid species that do not form clathrates can thereby be highly enriched in the resulting liquor. Aqueous extraction can be then be performed to remove urea followed by re-esterification of highly enriched mid-chain monoenic FAEE to glycerol. Finally, short path distillation can be used to remove unincorporated fatty acids, resulting in a highly enriched mid-chain monoenic TAG.

The fatty acid profile of the resulting triglyceride oil enriched in C10:1 $\Delta^4$ and C12:1 $\Delta^4$ fatty acids ("Enriched TAG") is shown in TABLE 2 along with the fatty acid profiles of eleven other triglyceride oils. Physicochemical properties of these various oils are also shown for comparison. TABLE 3 shows the pour point and the total MEFA and PUFA percent content of an enriched triglyceride oil described herein and ten naturally occurring triglyceride oils.

Figure 2A:
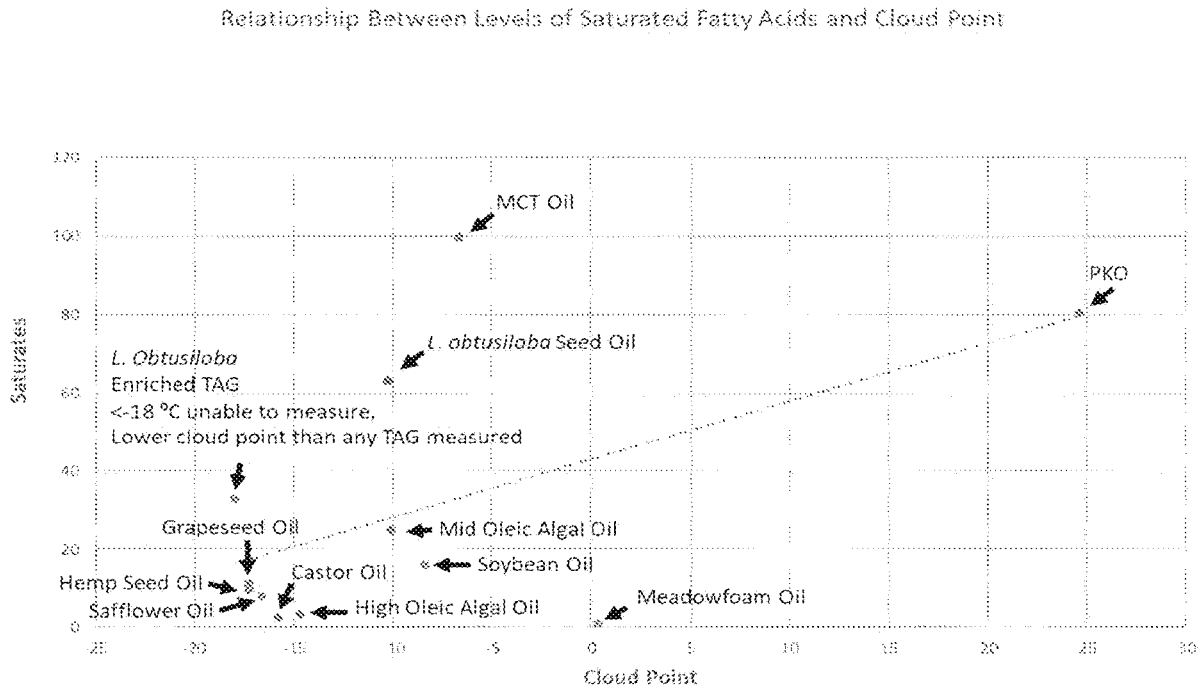
FIG. 2A illustrates the relationship between cloud point and saturate levels of various oils.
Figure 2B:
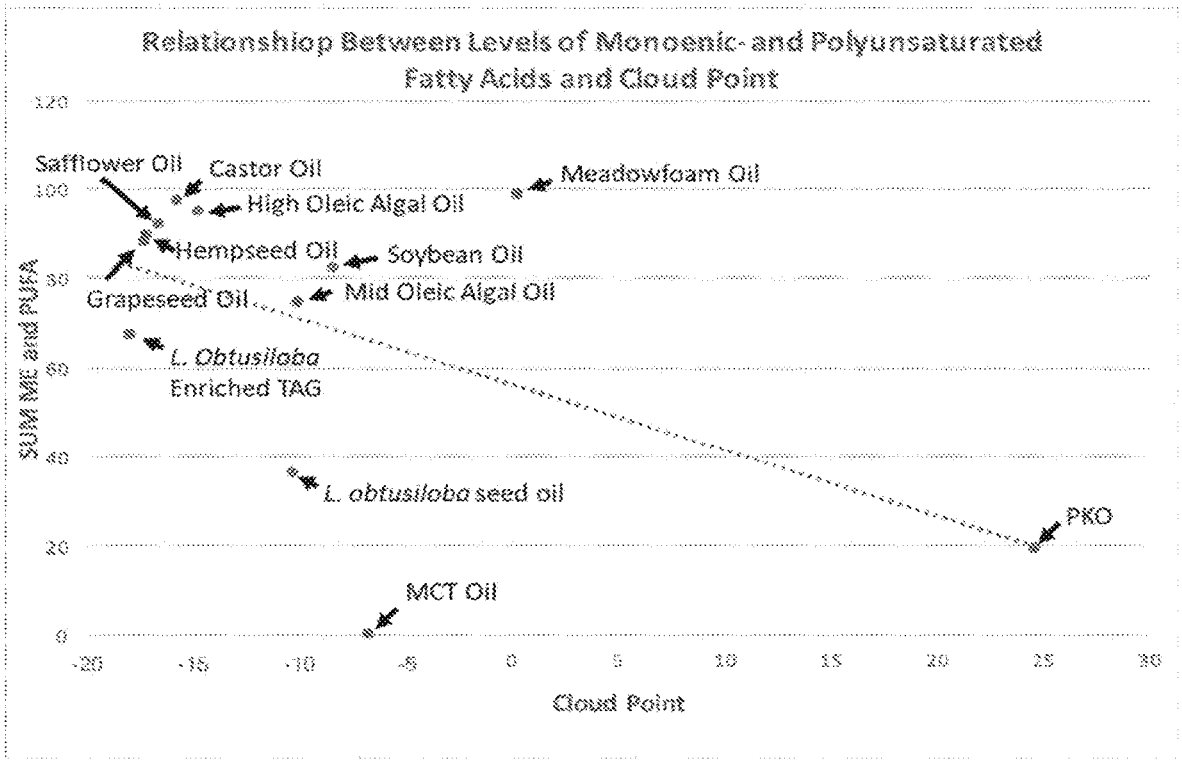
FIG. 2B illustrates the relationship between cloud point and total levels of monoenic and polyunsaturated fatty acids of various oils.
Figure 2C:
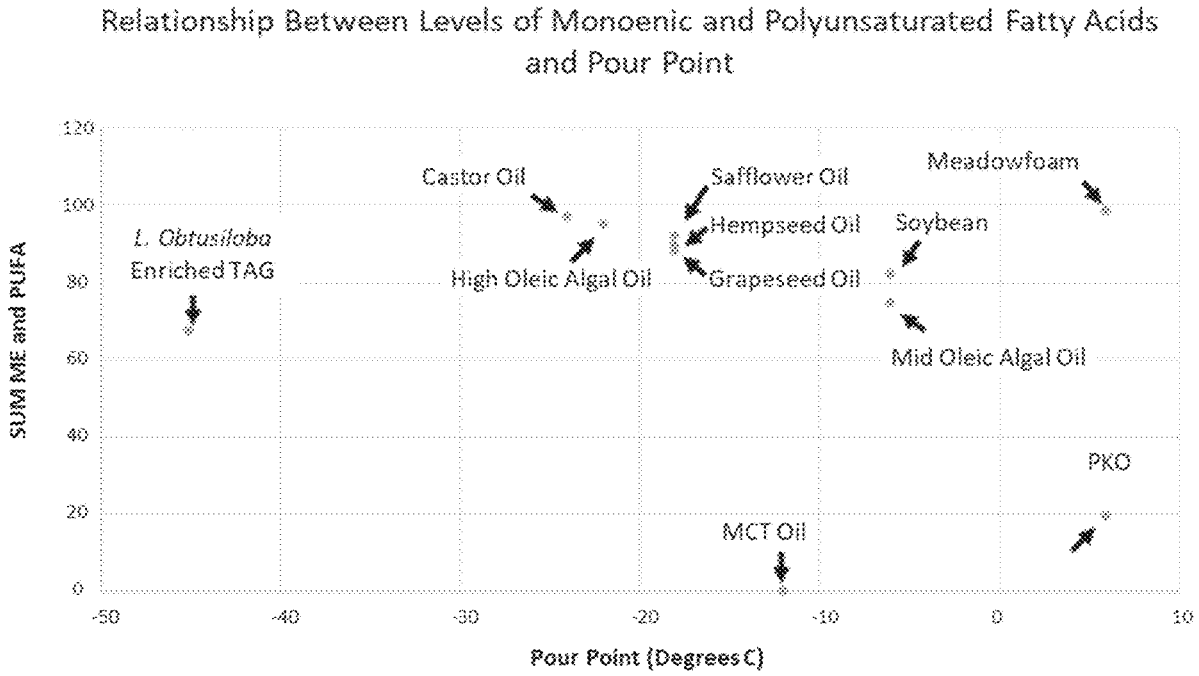
FIG. 2C illustrates the relationship between pour point and levels of monoenic and polyunsaturated fatty acids of various oils.

FIGS. 2A-2C illustrate how the physical properties of triglycerides can be influenced by composition with respect to saturation or degree of unsaturation. FIG. 2A illustrates the relationship between levels of saturates and cloud point. FIG. 2B illustrates the relationship between levels of degree of unsaturation and cloud point. FIG. 2C illustrates the relationship between levels of degree of unsaturation and pour point. The degree of unsaturation was determined as the sum of monoenic fatty acids and polyunsaturated fatty acids (SUM ME and PUFA).

As shown in FIG. 2A, the relationship between saturate levels and cloud point is weakened when MCT oils containing C8 and C10 fatty acids are considered in the trend, as these moieties tend to depress cloud point. Likewise, the very long chain fatty acids in meadowfoam oil, despite the high degree of monounsaturation, exhibits a higher than anticipated cloud point. Highly polyunsaturated oils, such as castor oil, tend to have lower cloud points and Mettler dropping points. As chain length decreases, however, such as in the C8 range, these oils also show depressed cloud points.

For example, the MCT oil contains virtually no double bonds and thus, has a saturate level of about 100%. The MCT oil possesses a relatively low cloud point of −6.7° C., significantly lower than that of palm kernel oil (PKO), which has a total saturate level of about 80% and a cloud point of almost 25° C. The oil from *L. obtusiloba* seeds shows the effects of two attributes on cloud point: unsaturation and chain length (See fatty acid composition in TABLE 2). *L. obtusiloba* seed oil saturate level is comparable to PKO (63% vs 80%, respectively). However, the *L. obtusiloba* seed oil cloud point is significantly lower than that of PKO, and even lower than that of the MCT oil. The *L. obtusiloba* seed oil suggests that short chain length combined with increased levels of unsaturation results in a synergistic effect, and hence, a highly depressed cloud point.

For example, these synergistic effects are even more pronounced with the enriched *L. obtusiloba* seed oil. Here, the unsaturate levels, largely in the form of the mid-chain monoenic species C12:1 $\Delta^4$ and, to a lesser extent, C10:1 $\Delta^4$, appear to drive cloud point and pour point (FIGS. 2B and 2C, and TABLE 3) to the lowest levels of any of the triglyceride species measured in this study. The cloud point of the enriched oil was determined to be so low that the cloud point was not measurable in the assay used. The enriched oil did not show any signs of crystallization even after 2 hours at −18° C.

Another validation of the synergy provided by the shorter chain length combined with the unsaturation can be gleaned through the comparison of the cloud points of the enriched *L. obtusiloba* oil with the mid-oleic algal oil. The two triglycerides have virtually identical levels of monoenic (ME) and polyunsaturated fatty acids (PUFA) of ~70%. However, the *L. obtusiloba* derived oil has a much lower cloud point (<−18° C. vs −15° C., respectively), as well as significantly lower viscosity, compared to the mid-oleic algal oil (42 vs 73 cSt, respectively). These superior properties can be attributed to the shorter chain lengths of the *L. obtusiloba* derived oil. The impact of unsaturation along with shorter acyl chain length can again be seen in comparing the weight percent of mid-chain fatty acids relative to all fatty acids (wt % MCT) for the oils shown in TABLE 2 and 3. The enriched triglyceride oil derived from *L. obtusiloba* and MCT oil both contain very high levels of mid-chain fatty acids (94% and 99%, respectively). However, the enriched triglyceride oil enriched for monoenic mid-chain fatty acids exhibits a much lower pour point than that of the MCT oil (more than 35° C. lower).

Castor oil is widely recognized as a natural seed oil possessing a very low cloud point and very low pour point, yet the enriched *L. obtusiloba* oil exhibits an even lower cloud point. In addition, one of the less desirable attributes of castor oil is its exceptionally high viscosity of over 800 cSt, attributing to poor flow properties. In contrast, oil compositions described herein that are enriched in mid-chain monoenic species have more favorable viscosities of just over 40 cSt.

TABLE 3 shows pour points of ten natural seed oils and an engineered triglyceride oil described herein resulting from the enrichment and re-esterification of *L. obtusiloba* mid-chain monoenic fatty acids to glycerol. Fatty acid profiles and physical properties are described in TABLE 2, including cloud point (limit of assay −18° C.), Mettler dropping point (samples showing ND failed to solidify and their freezing points fell below the capabilities of the instrument (−20° C.)), and kinematic viscosity (at 23° C., measured in centistokes (cSt)). Fatty acid compositions can be further characterized via gas chromatography and flame ionization detection (GC-FID) to determine total monoenic, polyunsaturated, and mid-chain triglyceride (C8, C10, and C12 fatty acids) levels. It should be noted that the cloud point value of compositions disclosed herein, e.g., an enriched *L. obtusiloba* oil, fell outside the capabilities of the assay as no cloud point was observed even after two hours at −18° C.

TABLE 3

| | Pour Point (° C.) | SUM MEFA and PUFA |
|---|---|---|
| Mid-Chain Triglyceride (MCT) Oil | −12 | 0.10 |
| L. obtusiloba Enriched TAG | −45 | 67.12 |
| Palm Kernel Oil | 6 | 19.45 |
| Hempseed Oil | −18 | 89.56 |
| Safflower Oil | −18 | 91.83 |
| Meadowfoam Oil | 6 | 98.32 |
| Grapeseed Oil | −18 | 87.92 |
| Castor Oil | −24 | 96.96 |
| Soybean Oil | −6 | 82.20 |
| High Oleic Algal Oil | −22 | 94.79 |
| Mid Oleic Algal Oil | −6 | 74.53 |

Fatty Acid Composition

In some embodiments, a triglyceride oil described herein comprises 4% or more, 5% or more, 6% or more, 7% or more, 8% or more, 9% or more, or 10% or more of a C10:1 fatty acid on a weight percentage basis.

In some embodiments, a triglyceride oil described herein comprises 21% or more, 22% or more, 23% or more, 24% or more, 25% or more, 30% or more, 35% or more, 40% or more, 45% or more, 50% or more, 51% or more, 52% or more, 53% or more, 54% or more, 55% or more, 56% or more, 57% or more, 58% or more, 59% or more, or 60% or more of a C12:1 fatty acid on a weight percentage basis.

In some embodiments, a triglyceride oil described herein comprises 25% or more of any one or more of a C10:1 fatty acid and a C12:1 fatty acid, or a combination thereof, on a weight percentage basis.

In some embodiments, a triglyceride oil described herein comprises 24% or more, 25% or more, 26% or more, 27% or more, 28% or more, 29% or more, or 30% or more of any one or more of a C10:1 fatty acid and a C12:1 fatty acid, or a combination thereof, on a weight percentage basis.

In some embodiments, a triglyceride oil described herein comprises 94% or more of a medium-chain fatty acid (MCFA) on a weight percentage basis, wherein MCFA is a C8 fatty acid, a C10 fatty acid, a C12 fatty acid, a C14 fatty acid, or a combination thereof.

In some embodiments, a triglyceride oil described herein comprises 94% or more, 95% or more, 96% or more, 97% or more, 98% or more, or 99% or more of a MCFA.

In some embodiments, a triglyceride oil described herein comprises 60% or more, 65% or more, 70% or more, 75% or more of a monoenic fatty acid (MEFA), a polyunsaturated fatty acid (PUFA), or a combination thereof. In some embodiments, a triglyceride oil described herein comprises 67% or more of a MEFA, a PUFA, or a combination thereof.

In some embodiments, a triglyceride oil described herein comprises 60% or more, 61% or more, 62% or more, 63% or more, 64% or more, 65% or more, 66% or more, 67% or more, 68% or more, 69% or more, 70% or more, 71% or more, 72% or more, 73% or more, 74% or more, or 75% or more of a MEFA and a PUFA in total.

In some embodiments, a triglyceride oil described herein comprises 65% or more of the MEFA, wherein the MEFA is a C10:1 fatty acid, a C12:1 fatty acid, a C14:1 fatty acid, a C16:1 fatty acid, a C18:1 fatty acid, a C20:1 fatty acid, a C22:1 fatty acid, a C24:1 fatty acid, or a combination thereof on a weight percentage basis.

In some embodiments, a triglyceride oil described herein comprises 60% or more, 61% or more, 62% or more, 63% or more, 64% or more, 65% or more, 66% or more, 67% or more, 68% or more, 69% or more, or 70% or more of a MEFA.

In some embodiments, a triglyceride oil described herein comprises 7% or more of a C10:1 fatty acid and 55% or more of a C12:1 fatty acid on a weight percentage basis.

In some embodiments, a triglyceride oil described herein comprises up to 2% of a C18:1 fatty acid on a weight percentage basis. In some embodiments, a triglyceride oil described herein comprises a C18:1 fatty acid at a weight percentage of up to 2%.

In some embodiments, a triglyceride oil described herein comprises up to 3% of the PUFA on a weight percentage basis. In some embodiments, a triglyceride oil described herein comprises a PUFA at a weight percentage of up to 3%. In some embodiments, a triglyceride oil described herein comprises up to 5%, up to 4%, up to 3%, up to 2%, or up to 1% of a PUFA on a weight percentage basis. A PUFA can be a C18:2 fatty acid, a C18:3 fatty acid, a C22:2 fatty acid, or a combination thereof.

In some embodiments, a triglyceride oil described herein comprises up to 3% of a C18:2 fatty acid on a weight percentage basis. In some embodiments, a triglyceride oil described herein comprises a C18:2 fatty acid at a weight percentage of up to 3%.

In some embodiments, a triglyceride oil described herein comprises 32% or more of a saturated fatty acid on a weight percentage basis, wherein the saturated fatty acid is a C6:0 fatty acid, a C8:0 fatty acid, a C10:0 fatty acid, a C12:0 fatty acid, a C14:0 fatty acid, a C16:0 fatty acid, a C18:0 fatty acid, a C20:0 fatty acid, a C22:0 fatty acid, a C24:0 fatty acid, or a combination thereof.

In some embodiments, a triglyceride oil described herein comprises 30% or more, 30% or more, 31% or more, 32% or more, 33% or more, 34% or more, 35% or more, 36% or more, 37% or more, 38% or more, 39% or more, 40% or more, 41% or more, 42% or more, 43% or more, 44% or more, 45% or more, 46% or more, 47% or more, 48% or more, 49% or more, or 50% or more of a saturated fatty acid on a weight percentage basis.

In some embodiments, a triglyceride oil described herein comprises up to 1% of a C6:0 fatty acid on a weight percentage basis. In some embodiments, a triglyceride oil described herein comprises a C6:0 fatty acid at a weight percentage of up to 1%.

In some embodiments, a triglyceride oil described herein comprises up to 1% of a C8:0 fatty acid on a weight percentage basis. In some embodiments, a triglyceride oil described herein comprises a C8:0 fatty acid at a weight percentage of up to 1%.

In some embodiments, a triglyceride oil described herein comprises 20% or more of a C10:0 fatty acid on a weight percentage basis. In some embodiments, a triglyceride oil described herein comprises a C10:0 fatty acid at a weight percentage of up to 23%. In some embodiments, a triglyceride oil described herein comprises up to 20%, up to 21%, up to 22%, up to 23%, up to 24%, or up to 25% of a C10:0 fatty acid on a weight percentage basis.

In some embodiments, a triglyceride oil described herein comprises up to 9% of a C12:0 fatty acid on a weight percentage basis. In some embodiments, a triglyceride oil described herein comprises a C12:0 fatty acid at a weight percentage of up to 9%.

In some embodiments, a triglyceride oil described herein comprises up to 1% of a C14:0 fatty acid on a weight percentage basis. In some embodiments, a triglyceride oil described herein comprises a C14:0 fatty acid at a weight percentage of up to 1%.

In some embodiments, a triglyceride oil described herein comprises up to 1% of a C16:0 fatty acid on a weight percentage basis. In some embodiments, a triglyceride oil described herein comprises a C16:0 fatty acid at a weight percentage of up to 1%.

In some embodiments, a triglyceride oil described herein comprises up to 1% of a C18:0 fatty acid on a weight percentage basis. In some embodiments, a triglyceride oil described herein comprises a C18:0 fatty acid at a weight percentage of up to 1%.

In some embodiments, a triglyceride oil described herein comprises 22% or more of a C10:0 fatty acid, 7% or more of a C10:1 fatty acid, 8% or more of a C12:0 fatty acid, and 55% or more of a C12:1 fatty acid on a weight percentage basis.

In some embodiments, a triglyceride oil described herein comprises 22% or more of a C10:0 fatty acid, 7% or more of a C10:1 fatty acid, 8% or more of a C12:0 fatty acid, 55% or more of a C12:1 fatty acid, up to 2% of a C18:1 fatty acid, and up to 3% of a C18:2 fatty acid on a weight percentage basis.

In some embodiments, a triglyceride oil described herein comprises up to 1% of a C8:0 fatty acid, 22% or more of a C10:0 fatty acid, 7% or more of a C10:1 fatty acid, 8% or more of a C12:0 fatty acid, 55% or more of a C12:1 fatty acid, up to 2% of a C18:1 fatty acid, and up to 3% of a C18:2 fatty acid on a weight percentage basis.

Rheological Properties

In some embodiments, a triglyceride oil described herein has a cloud point that is −11° C. or lower, −12° C. or lower, −13° C. or lower, −14° C. or lower, −15° C. or lower, −16° C. or lower, −17° C. or lower, −18° C. or lower, −19° C. or lower, or −20° C. or lower. In some embodiments, a triglyceride oil described herein has a cloud point that is −11° C., −12° C., −13° C., −14° C., −15° C., −16° C., −17° C., −18° C., −19° C., −20° C., −25° C., or −30° C.

In some embodiments, a triglyceride oil described herein has a pour point that is −25° C., −26° C., −27° C., −28° C., −29° C., −30° C., −31° C., −32° C., −33° C., −34° C., −35° C., −36° C., −37° C., −38° C., −39° C., −40° C., −41° C., −42° C., −43° C., −44° C., or −45° C. In some embodiments, a triglyceride oil described herein has a pour point that is −25° C. or lower, −30° C. or lower, −35° C. or lower, −40° C. or lower, −45° C. or lower, or −50° C. or lower.

In some embodiments, a triglyceride oil described herein has an iodine value that is up to 40, up to 45, up to 50, up to 55, up to 60 or higher, up to 65, up to 70, up to 75, up to 80, up to 81, up to 82, or up to 83. In some embodiments, a triglyceride oil described herein has an iodine value that is between 44 and 82. In some embodiments, a triglyceride oil described herein has an iodine value that is 83.

In some embodiments, a triglyceride oil described herein has a kinematic viscosity that is up to 40 cSt, up to 41 cSt, up to 42 cSt, up to 43 cSt, up to 44 cSt, up to 45 cSt, up to 46 cSt, up to 47 cSt, up to 48 cSt, up to 49 cSt, up to 50 cSt, up to 60 cSt, up to 70 cSt, or up to 80 cSt.

Microbial Oils

In some embodiments, a triglyceride oil described herein is derived from a microbial oil. Microbial oils may be produced using oleaginous microbes. Oleaginous microbes can refer to species of microbes having oil contents in excess of 20% on a dry cell weight basis. These microbes are uniquely suited for generating highly pure, natural oil polyols with hydroxyl functionality. Oleaginous microbes have also been proven extremely facile for genetic modification and improvement.

Indeed, these improvements can occur on time scales that are greatly accelerated relative to what can be achieved in higher plant oilseeds. Oleaginous microbes offer tremendous utility in generating large quantities of triglyceride oils in short periods of time. In as little as 48 hours, appreciable oil production of about 30-40% oil (dry cell weight) can be obtained, whereas typical production requires 120 hours or more to achieve 70-80% oil (dry cell weight).

Furthermore, because these microbes can be heterotrophically grown using simple sugars, the production of these triglyceride oils can be divorced from the traditional constraints imposed by geography, climate, and season that constrain triglyceride oil production from oilseed crops.

Recombinant DNA techniques can be used to engineer or modify oleaginous microbes to produce triglyceride oils having desired fatty acid profiles and regiospecific or stereospecific profiles. Fatty acid biosynthetic genes, including, for example, those encoding stearoyl-ACP desaturase, delta-12 fatty acid desaturase, acyl-ACP thioesterase, ketoacyl-ACP synthase, and lysophosphatidic acid acyltransferase can be manipulated to increase or decrease expression levels and thereby biosynthetic activity. These genetically engineered microbes can produce oils having enhanced oxidative, or thermal stability, rendering a sustainable feedstock source for various chemical processes. The fatty acid profile of the oils can be enriched in midchain profiles or the oil can be enriched in triglycerides having specific saturation or unsaturation contents. WO2010/063031, WO2010/120923, WO2012/061647, WO2012/106560, WO2013/082186, WO2013/158938, WO2014/176515, WO2015/051319, and Lin et al. (2013) *Bioengineered,* 4:292-304, and Shi and Zhao. (2017) *Front. Microbiol.,* 8: 2185 each discloses microbe genetic engineering techniques for oil production. In some embodiments, a triglyceride oil described herein is produced by recombinant techniques or genetic engineering. In some embodiments, a triglyceride oil described herein is not produced by recombinant techniques or genetic engineering.

Among microalgae, several genera and species are suitable for producing triglyceride oils that can be converted to polyols including, but not limited to, *Chlorella* sp., *Pseudochlorella* sp., *Prototheca* sp., *Arthrospira* sp., *Euglena* sp., *Nannochloropsis* sp. *Phaeodactylum* sp., *Chlamydomonas* sp., *Scenedesmus* sp., *Ostreococcus* sp., *Selenastrum* sp., *Haematococcus* sp., *Nitzschia, Dunaliella, Navicula* sp., *Pseudotrebouxia* sp., *Heterochlorella* sp., *Trebouxia* sp., *Vavicula* sp., *Bracteococcus* sp., *Gomphonema* sp., *Watanabea* sp., *Botryococcus* sp., *Tetraselmis* sp., and *Isochrysis* sp.

Among oleaginous yeasts, several genera are suitable for producing triglyceride oils that can be converted to polyols including, but not limited to, *Candida* sp., *Cryptococcus* sp., *Debaromyces* sp., *Endomycopsis* sp., *Geotrichum* sp., *Hyphopichia* sp., *Lipomyces* sp., *Pichia* sp., *Rodosporidium* sp., *Rhodotorula* sp., *Sporobolomyces* sp., *Starmerella* sp., *Torulaspora* sp., *Trichosporon* sp., *Wickerhamomyces* sp., *Yarrowia* sp., and *Zygoascus* sp.

Among oleaginous bacteria there are several genera and species which are suited to producing triglyceride oils that can be converted to polyols including, but not limited to *Flavimonas oryzihabitans, Pseudomonas aeruginosa, Morococcus* sp., *Rhodobacter sphaeroides, Rhodococcus opacus, Rhodococcus erythropolis, Streptomyces jeddahensis, Ochrobactrum* sp., *Arthrobacter* sp., *Nocardia* sp., *Mycobacteria* sp., *Gordonia* sp., *Catenisphaera* sp., and *Dietzia* sp.

Oleaginous microbes may be cultivated in a bioreactor or fermenter. For example, heterotrophic oleaginous microbes can be cultivated on a sugar-containing nutrient broth.

Oleaginous microbes produce microbial oil, which comprises triacylglycerides or triacylglycerols and may be stored in storage bodies of the cell. A raw oil may be obtained from microbes by disrupting the cells and isolating the oil. WO2008/151149, WO2010/06032, WO2011/150410, WO2012/061647, and WO2012/106560 each discloses heterotrophic cultivation and oil isolation techniques. For example, microbial oil may be obtained by providing or cultivating, drying and pressing the cells. Microbial oils produced may be refined, bleached, and deodorized (RBD) as described in WO2010/120939, which is entirely incorporated herein by reference. Microbial oils can be obtained without further enrichment of one or more fatty acids or triglycerides with respect to other fatty acids or triglycerides in the raw oil composition.

Triglyceride Oil Compositions

A triglyceride oil of the present disclosure can have one or more of the following characteristics:

- Having 6% or more of a C10:1 fatty acid on a weight percentage basis;
- Having 25% or more of any one or more of a C10:1 fatty acid and a C12:1 fatty acid, or a combination thereof, on a weight percentage basis;
- Having 94% or more of a MCFA on a weight percentage basis;
- Having 67% or more of a MEFA, a PUFA, or a combination thereof, on a weight percentage basis;
- Having 65% or more of a MEFA on a weight percentage basis;
- Having 7% or more of a C10:1 fatty acid and 55% or more of a C12:1 fatty acid on a weight percentage basis;
- Having up to 2% of a C18:1 fatty acid on a weight percentage basis;
- Having a C18:1 fatty acid at a weight percentage of up to 2%;
- Having up to 3% of a PUFA on a weight percentage basis;
- Having a PUFA at a weight percentage of up to 3%;
- Having up to 3% of a C18:2 fatty acid on a weight percentage basis;
- Having a C18:2 fatty acid at a weight percentage of up to 3%;
- Having 32% or more of a saturated fatty acid on a weight percentage basis;
- Having up to 1% of a C6:0 fatty acid on a weight percentage basis;
- Having a C6:0 fatty acid at a weight percentage of up to 1%;
- Having up to 1% of a C8:0 fatty acid on a weight percentage basis;
- Having a C8:0 fatty acid at a weight percentage of up to 1%;
- Having 20% or more of a C10:0 fatty acid on a weight percentage basis;
- Having a C10:0 fatty acid at a weight percentage of up to 23%;
- Having up to 9% of a C12:0 fatty acid on a weight percentage basis;
- Having a C12:0 fatty acid at a weight percentage of up to 9%;
- Having up to 1% of a C14:0 fatty acid on a weight percentage basis;

Having a C14:0 fatty acid at a weight percentage of up to 1%;

Having up to 1% of a C16:0 fatty acid on a weight percentage basis;

Having a C16:0 fatty acid at a weight percentage of up to 1%;

Having up to 1% of a C18:0 fatty acid on a weight percentage basis;

Having a C18:0 fatty acid at a weight percentage of up to 1%;

Having up to 1% of a C8:0 fatty acid, up to 23% of a C10:0 fatty acid, up to 9% of a C12:0 fatty acid, up to 1% of a C14:0 fatty acid, and up to 1% of a C16:0 fatty acid on a weight percentage basis;

Having up to 1% of a C8:0 fatty acid, up to 23% of a C10:0 fatty acid, 7% or more of a C10:1 fatty acid, up to 8% of a C12:0 fatty acid, 55% or more of a C12:1 fatty acid, and up to 1% of a C14:0 fatty acid on a weight percentage basis;

Having a cloud point that is −11° C. or lower;

Having a cloud point that is −18° C. or lower;

Having a cloud point that is −18° C.;

Having a pour point that is −45° C. or lower;

Having a pour point that is −45° C.;

Having an iodine value that is 83 or higher;

Having an iodine value that is between 44 and 82;

Having an iodine value that is 83;

Having a kinematic viscosity that is up to 80 cSt;

Having a kinematic viscosity that is up to 42 cSt;

Having a kinematic viscosity that is 42 cSt;

Having up to 3% of a PUFA on a weight percentage basis, a kinematic viscosity that is up to 42 cSt, and a cloud point that is −18° C. or lower;

Having a PUFA at a weight percentage of up to 3%;

Having 32% or more of a saturated fatty acid on a weight percentage basis, and a cloud point that is −18° C. or lower;

Is isolated from a seed;

Is naturally occurring;

Is cell free;

Is produced in planta;

Is produced ex planta;

Is produced through chemical re-esterification of fatty acid esters to glycerol;

Is produced through strain selection;

Is produced through crossbreeding;

Is produced through genetic engineering;

Does not contain an additive, such as a cloud point depressant, a pour point depressant, a biodiesel, a mineral oil, a petroleum-based additive, a polyalkylmethaacrylate (PAMA), a polyacrylate, an acrylate-styrene copolymer, an esterified olefin copolymer, a styrene maleic anhydride copolymer, an alkylated polystyrene, a vinyl acetate-fumarate copolymer, or a halogenated wax; or Have any combination of the above characteristics.

EXAMPLES

Example 1. Production of C10:1 and C12:1 Enriched TAG from *Lindera obtusiloba*

Seeds and oil of *L. obtusiloba* were processed as diagramed in FIG. 1. Crude clarified oil was generated from 6.3 kg seeds of *L. obtusiloba* via extraction with isohexane at an amount of 6:1 solvent to biomass in a bead mill. The crude oil was then clarified by acid degumming using citric acid to remove the phospholipid fraction. The clarified oil was further purified by refining and bleaching using citric acid and 126 FF bleaching clay. The degummed-bleached oil was then subjected to transesterification with ethanol to generate FAEE, which were subsequently subjected to urea crystallization to generate urea-FAEE clathrates. The urea-FAEE clathrates were filtered out to remove urea-saturated fatty acid clathrates. Aqueous extraction of monoenic fatty acids, now enriched in the resulting liquor, was then carried out to remove urea. The resulting liquor enriched in the monoenic free fatty acids was then subjected to re-esterification to restore the glycerol backbone (10-20% excess of mid-chain monoenic FAEE) using sodium ethoxide or potassium ethoxide. Finally, the triglyceride oil was then subjected to short path distillation to remove unincorporated fatty acids.

As described in TABLE 2, the enriched *L. obtusiloba* seed oil is composed of about 55% C12:1 and about 7% C10:1 fatty acids (Enriched TAG). The cloud point was determined to be −18° C. or lower, as the value fell outside the capabilities of the assay (−18° C.). No cloud point was observed after two hours at −18° C.

Example 2. Polyurethane Applications Using Mid-Chain Monoenic Fatty Acid Enriched TAGs A triglyceride oil enriched in mid-chain monoenic fatty acid described herein can be used in polyurethane applications. For example, the enriched TAG can be used to generate a polyol using various chemistries, including, for example, epoxidation and ring opening, hydroformylation and reduction, and ozonolysis. Polyols derived from these bio-based TAGs can contain fatty acid chains of 10 or 12 carbons in length, depending upon whether the polyol is derived from C10:1 $\Delta^4$ or C12:1 $\Delta^4$ fatty acids. Polyols produced in such a way would contain secondary hydroxyls. Polyols having shorter acyl chain lengths can provide a benefit to the structural properties of a polyurethane material.

Epoxidation and subsequent ring opening across the carbon-carbon double bonds of the TAG can be carried out using a variety of reagents including, for example, water, hydrogen, methanol, ethanol, propanol, isopropanol, or other polyols. Ring opening can be facilitated by reaction with an alcohol, including, for example, β-substituted alcohols. These chemistries result in secondary hydroxyl moieties, which are less reactive than primary hydroxyl moieties, for example, with isocyanate or methyl esters.

Hydroformylation with synthesis gas (syngas) can be carried out using rhodium or cobalt catalysts to form the aldehyde at the olefinic group. The aldehyde can subsequently undergo reduction to an alcohol in the presence of hydrogen and a nickel catalyst to generate the polyol. Polyols formed by these chemistries contain primary hydroxyl groups which can be more reactive than those generated through epoxidation and ring opening. Increased levels of primary hydroxyl groups can thereby increase the functionality, reactivity, and crosslinking during subsequent polymerization reactions. The quantity and type of crosslinking can influence the stability, durability, and rigidity of the resulting polymer.

Mid-chain monoenic enriched oils can also be subjected to ozonolysis by molecular oxygen across carbon-carbon double bonds to form ozonides. Further oxidation of ozonides results in scission of the double bond and formation of a diacid and a carboxylic acid. Subsequent reduction of these products with hydrogen results in the formation of aldehydes. Ozonolysis and reduction of oleic acid, for example, produces azaleic acid, pelargonic acid, and pelargonaldehyde, respectively. Ozonolysis and reduction of an oil enriched in C10:1 $\Delta^4$ and C12:1 $\Delta^4$ fatty acids, for example, produces succinic acid and hexanaldehyde, and octanaldehyde, respectively. Hexanaldehyde and octanaldehyde both have applications in the fragrance and food industries. Succinic acid, on the other hand, can be converted to a variety of valuable products using rhodium catalysts, for example, 1,4-butanediol. Succinic acid can also be used directly as a polymer feedstock for other bio-based polymers, including, for example, polybutylene succinate or polybutylene succinate adipate.

Example 3. Lubricant Applications Using Mid-Chain Monoenic Fatty Acid Enriched TAGs A triglyceride oil enriched in mid-chain monoenic fatty acid described herein can be used in lubricant applications. These enriched TAGs can serve as superior alternatives to traditional vegetable oil-based lubricants. First, the enriched TAGs have significantly lower viscosity than traditional vegetable oil-based lubricants (viscosity levels of vegetable oil-based lubricants are shown in TABLE 2). Second, the enriched TAGs have very low pour points compared to currently available triglyceride oils. Third, the enriched TAGs have very low levels of polyunsaturated fatty acids, which is indicative of superior oxidative stability. These properties can be achieved in absence of an additive that modifies the rheological properties of a TAG. Non-limiting examples of additives include cold flow improvers, cloud point depressants, pour point depressants, for example, biodiesel, mineral oil, petroleum-based additives, polyalkylmethaacrylate (PAMA), polyacrylates, acrylate-styrene copolymers, esterified olefin copolymers, styrene maleic anhydride copolymers, alkylated polystyrenes, vinyl acetate-fumarate copolymers, and halogenated waxes.

Example 4. Dielectric Fluid Applications Using Mid-Chain Monoenic Fatty Acid Enriched TAGs A triglyceride oil enriched in mid-chain monoenic fatty acid described herein can be used in dielectric fluid applications. These enriched TAGs have superior dielectric fluid properties due to their low viscosity and exceptionally low pour points compared to currently available triglyceride oil-based dielectric fluids. These properties are achieved in absence of additives. In addition, these enriched TAGs have substantially higher flash points (>500° F.) than mineral oil (140° F.), the current petroleum-based standard. The very low levels of polyunsaturated fatty acids in these enriched TAGs also confer superior oxidative stability.

Example 5. Heat Transfer Fluids and Coolant Applications Using Mid-Chain Monoenic Fatty Acid Enriched TAGs A triglyceride oil enriched in mid-chain monoenic fatty acid described herein can be used as heat transfer fluids and coolants, for example, in large server farm environments. The superior properties of the enriched TAGs for use as heat transfer agents and coolants are again attributed to the unique combination of having low viscosity and an exceptionally low pour point.

Example 6. Biodiesel Applications Using Mid-Chain Monoenic Fatty Acid Enriched TAGs A triglyceride oil enriched in mid-chain monoenic fatty acid described herein can be used in biodiesel and fuel applications. The superior properties of the enriched TAGs for use as biodiesels and fuels are again attributed to the unique combination of having low viscosity, an exceptionally low pour point, and superior oxidative stability compared to currently available alternatives.

Example 7. Personal Care Product Applications Using Mid-Chain Monoenic Fatty Acid Enriched TAGs A triglyceride oil enriched in mid-chain monoenic fatty acid described herein can be used in personal care product applications. Non-limiting examples of personal care product applications include body oils, hair oils, bath oils, bar soaps, liquid soaps, moisturizers, lotions, skin creams, sun care products, and lip balms. For example, due to their low viscosity, these enriched TAGs can serve as an effective dispersant for fragrances and scents. As another example, such triglyceride oils can be treated with potassium hydroxide, sodium hydroxide, or other suitable bases to achieve lathering and foaming properties of soap products.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A triglyceride oil comprising:

a C10:0 fatty acid at an amount of greater than 0% and up to 25%, a C10:1 fatty acid at an amount of 5% or more, a C12:0 fatty acid at an amount of greater than 0% and up to 9%, and a C12:1 fatty acid at an amount of 50% or more on a weight percentage basis.

2. The oil of claim 1, wherein the oil comprises 95% or more of mid-chain fatty acids (MCFAs) on a weight percentage basis, wherein the MCFAs comprise C8, C10, C12, and C14 fatty acids.

3. The oil of claim 1, wherein the oil further comprises a C8:1 fatty acid at an amount of greater than 0% and 1% on a weight percentage basis.

4. The oil of claim 1, wherein the oil comprises the C10:1 fatty acid at an amount of 7% or more on a weight percentage basis.

5. The oil of claim 1, wherein the oil comprises the C10:1 fatty acid at an amount of 10% or more on a weight percentage basis.

6. The oil of claim 1, wherein the oil comprises the C12:1 fatty acid at an amount of 55% or more on a weight percentage basis.

7. The oil of claim 1, wherein the oil comprises 7% or more of the C10:1 fatty acid and 55% or more of the C12:1 fatty acid on a weight percentage basis.

8. The oil of claim 1, wherein the oil comprises 60% or more of monoenic fatty acids (MEFAs) on a weight percentage basis, wherein the MEFAs comprise the C10:1 fatty acid and the C12:1 fatty acid.

9. The oil of claim 1, wherein the oil further comprises a MEFA selected from the group consisting of: a C14:1 fatty acid, a C16:1 fatty acid, a C18:1 fatty acid, a C20:1 fatty acid, a C22:1 fatty acid, and a C24:1 fatty acid.

10. The oil of claim 1, wherein the oil comprises polyunsaturated fatty acids (PUFAs) at an amount of greater than 0% and up to 3% on a weight percentage basis.

11. The oil of claim 10, wherein the PUFAs comprise a C18:2 fatty acid, a C18:3 fatty acid, and a C22:2 fatty acid.

12. The oil of claim 1, wherein the oil comprises:

a C8:0 fatty acid at an amount of greater than 0% up to 1%, the C10:0 fatty acid at an amount of greater than 0% up to 23%, the C10:1 fatty acid at an amount of 7% or more, the C12:0 fatty acid at an amount of greater than 0% up to 8%, the C12:1 fatty acid 55% or more of, and a C14:0 fatty acid at an amount of greater than 0% up to 1% on a weight percentage basis.

13. The oil of claim 1, wherein said oil has a cloud point that is −11° C. or lower.

14. The oil of claim 1, wherein said oil has a cloud point that is −18° C.

15. The oil of claim 1, wherein said oil has a pour point that is −45° C. or lower.

16. The oil of claim 1, wherein said oil has a pour point that is −45° C.

17. The oil of claim 1, wherein said oil has an iodine value that is 83 or higher.

18. The oil of claim 1, wherein said oil has an iodine value that is 83.

19. The oil of claim 1, wherein said oil has a kinematic viscosity that is up to 42 cSt.

20. The oil of claim 1, wherein said oil has a kinematic viscosity that is 42 cSt.

* * * * *